US011028566B2

(12) United States Patent
Theus

(10) Patent No.: US 11,028,566 B2
(45) Date of Patent: Jun. 8, 2021

(54) BATHROOM CLEANING ASSEMBLY

(71) Applicant: Odigaise Theus, Greenacres, FL (US)

(72) Inventor: Odigaise Theus, Greenacres, FL (US)

( * ) Notice: Subject to any disclaimer, the term of this patent is extended or adjusted under 35 U.S.C. 154(b) by 0 days.

(21) Appl. No.: 15/824,703

(22) Filed: Nov. 28, 2017

(65) Prior Publication Data

US 2019/0161950 A1 May 30, 2019

(51) Int. Cl.

| | |
|---|---|
| ***E03D 9/00*** | (2006.01) |
| ***E03D 9/04*** | (2006.01) |
| ***A47K 3/00*** | (2006.01) |
| ***A47L 11/03*** | (2006.01) |
| ***A47K 3/28*** | (2006.01) |
| ***A47L 11/20*** | (2006.01) |

(52) U.S. Cl.

CPC ..... *E03D 9/002* (2013.01); *A47K 3/001* (2013.01); *A47K 3/281* (2013.01); *A47L 11/03* (2013.01); *A47L 11/201* (2013.01); *E03D 9/007* (2013.01); *E03D 9/04* (2013.01)

(58) Field of Classification Search

USPC ..... 222/132, 135, 608; 4/662

See application file for complete search history.

(56) References Cited

U.S. PATENT DOCUMENTS

| | | | | |
|---|---|---|---|---|
| 3,742,520 | A | 7/1973 | Bernardi | |
| 4,872,225 | A | 10/1989 | Wagner | |
| 5,154,317 | A * | 10/1992 | Roppolo, III | B05B 9/007 222/331 |
| D341,235 | S | 11/1993 | Cuomo et al. | |
| 5,452,485 | A | 9/1995 | Ross | |
| 6,199,241 | B1 | 3/2001 | Anumah | |
| 6,742,199 | B2 | 6/2004 | Conway et al. | |
| 6,820,821 | B2 | 11/2004 | Linstedt et al. | |
| 7,004,663 | B1 | 2/2006 | Cupidon-Ebanks | |
| 7,523,512 | B1 | 4/2009 | Delaney et al. | |
| 2004/0060946 | A1 * | 4/2004 | Floyd | B01F 5/0403 222/132 |

* cited by examiner

*Primary Examiner* — Lauren A Crane

(57) ABSTRACT

A bathroom cleaning assembly for cleaning a bathroom includes a housing. A handle is slidably coupled to the housing for gripping. A pair of wheels is each rotatably coupled to the housing for rolling along a support surface. A plurality of dispensing units is provided and each of the dispensing units is positioned in the housing. Moreover, each of the dispensing units contains a fluid. A plurality of brushes is provided and a selected one of the brushes is selectively and fluidly coupled to a selected one of the dispensing units. The selected brush dispenses the fluid from the selected dispensing unit for cleaning the bathroom. A vacuum unit is positioned in the housing for vacuuming debris from the bathroom.

14 Claims, 5 Drawing Sheets

BATHROOM CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cleaning devices and more particularly pertains to a new cleaning device for cleaning a bathroom.

(2) Description of Related Art including information disclosed under 37 CFR 1.97 and 1.98.

The prior art relates to cleaning devices.

BRIEF SUMMARY OF THE INVENTION

An embodiment of the disclosure meets the needs presented above by generally comprising a housing. A handle is slidably coupled to the housing for gripping. A pair of wheels is each rotatably coupled to the housing for rolling along a support surface. A plurality of dispensing units is provided and each of the dispensing units is positioned in the housing. Moreover, each of the dispensing units contains a fluid. A plurality of brushes is provided and a selected one of the brushes is selectively and fluidly coupled to a selected one of the dispensing units. The selected brush dispenses the fluid from the selected dispensing unit for cleaning the bathroom. A vacuum unit is positioned in the housing for vacuuming debris from the bathroom.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
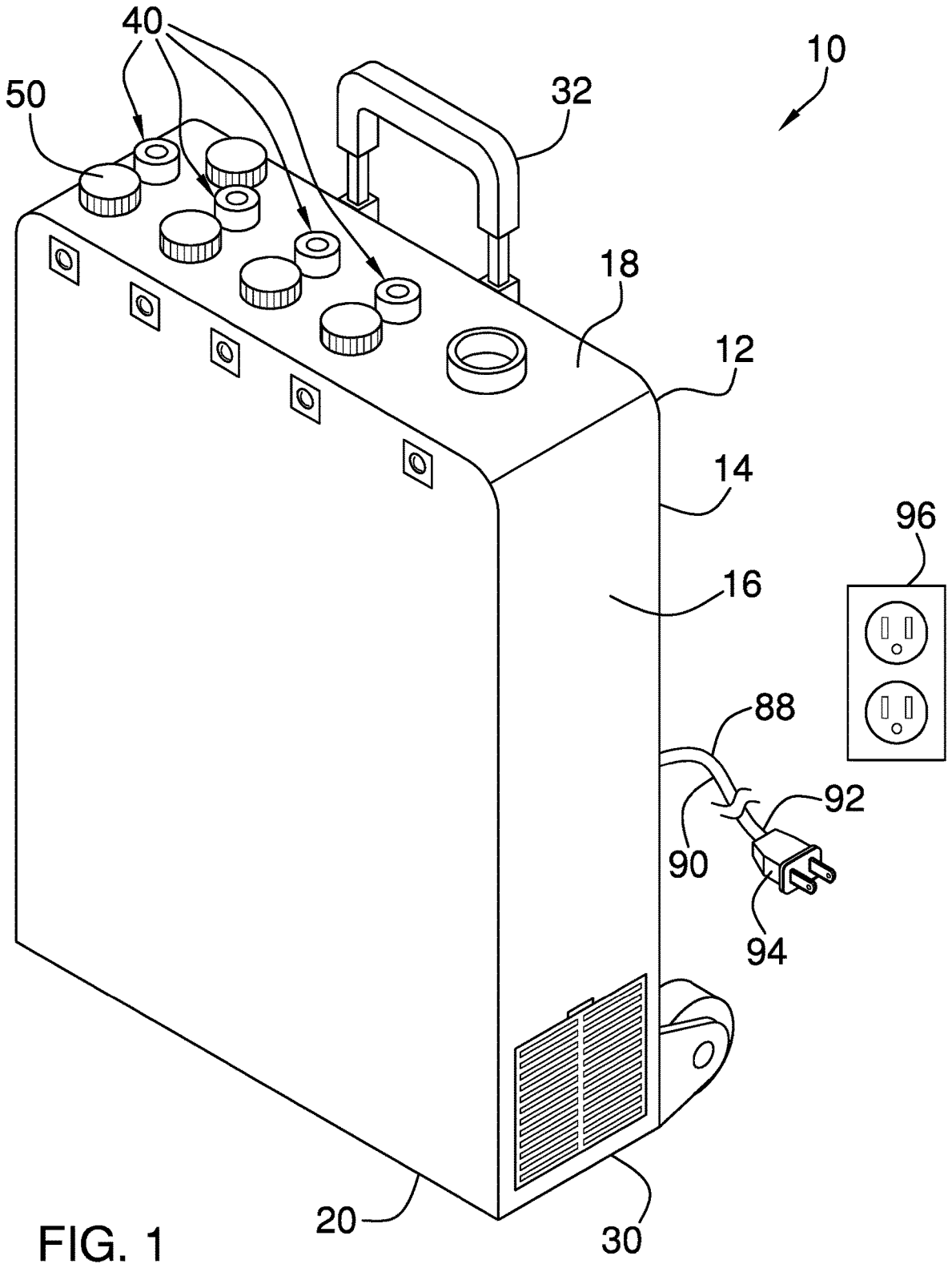
FIG. 1 is a front perspective view of a bathroom cleaning assembly according to an embodiment of the disclosure.
Figure 2:
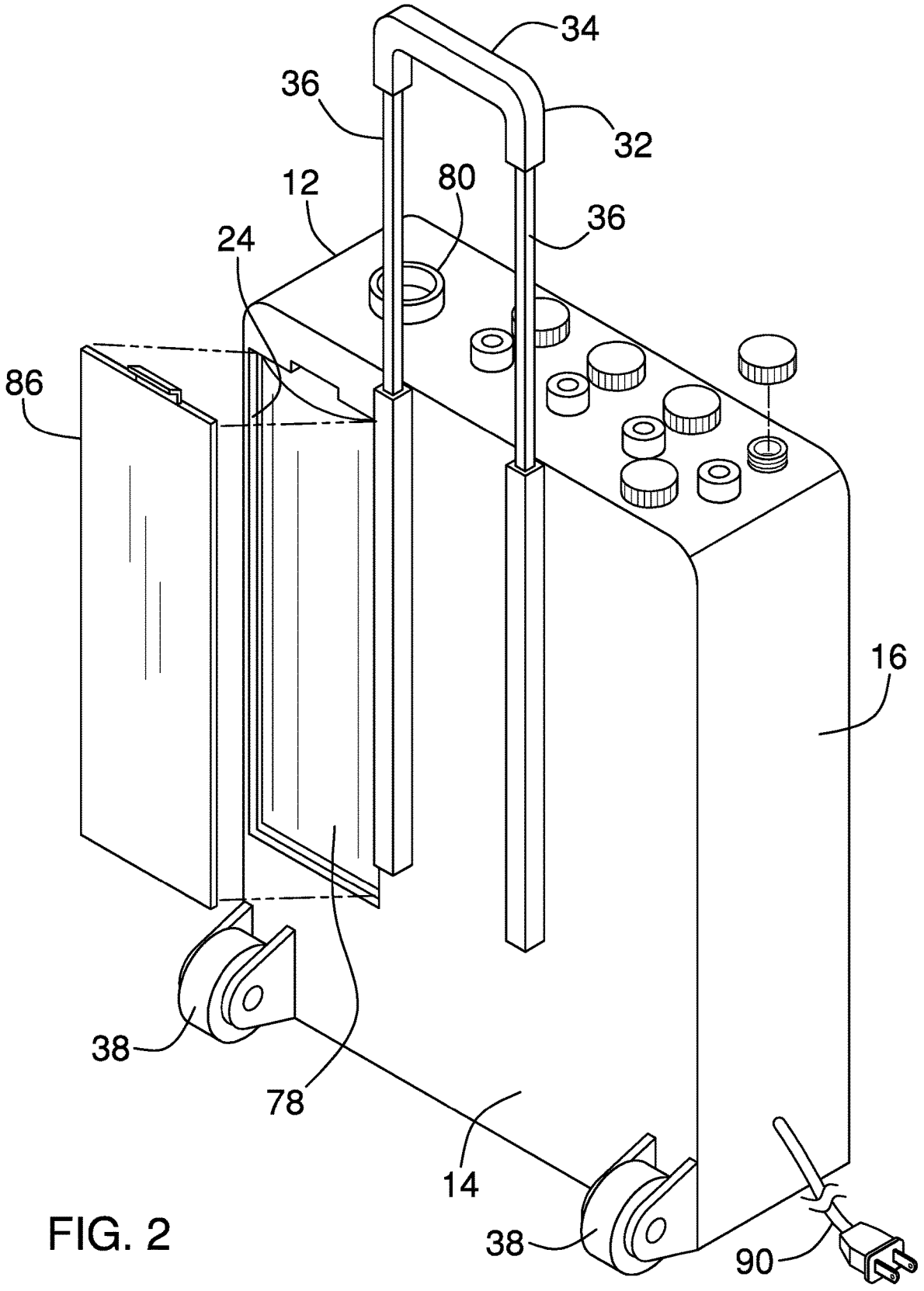
FIG. 2 is a back perspective view of an embodiment of the disclosure.
Figure 3:
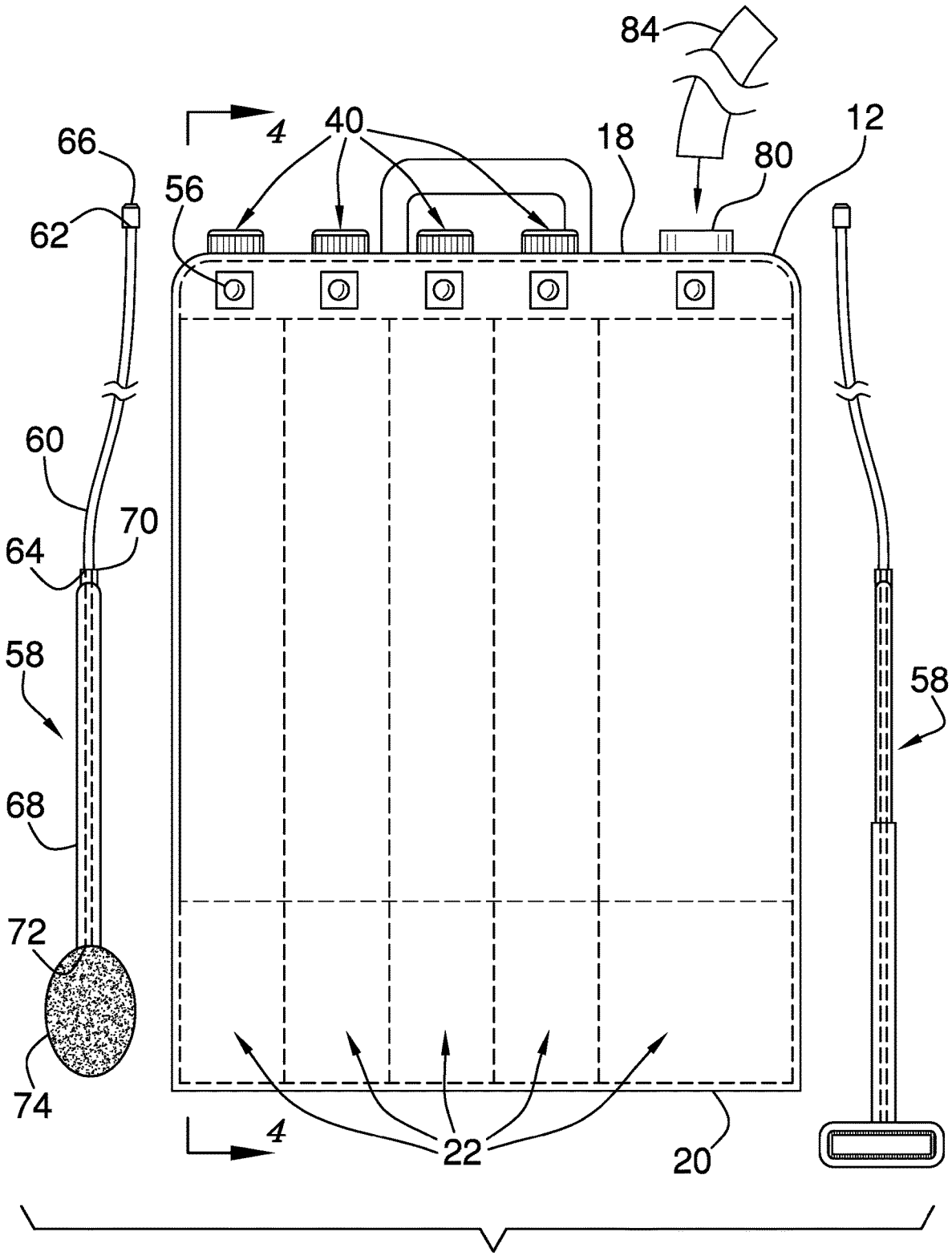
FIG. 3 is a front phantom view of an embodiment of the disclosure.
Figure 4:
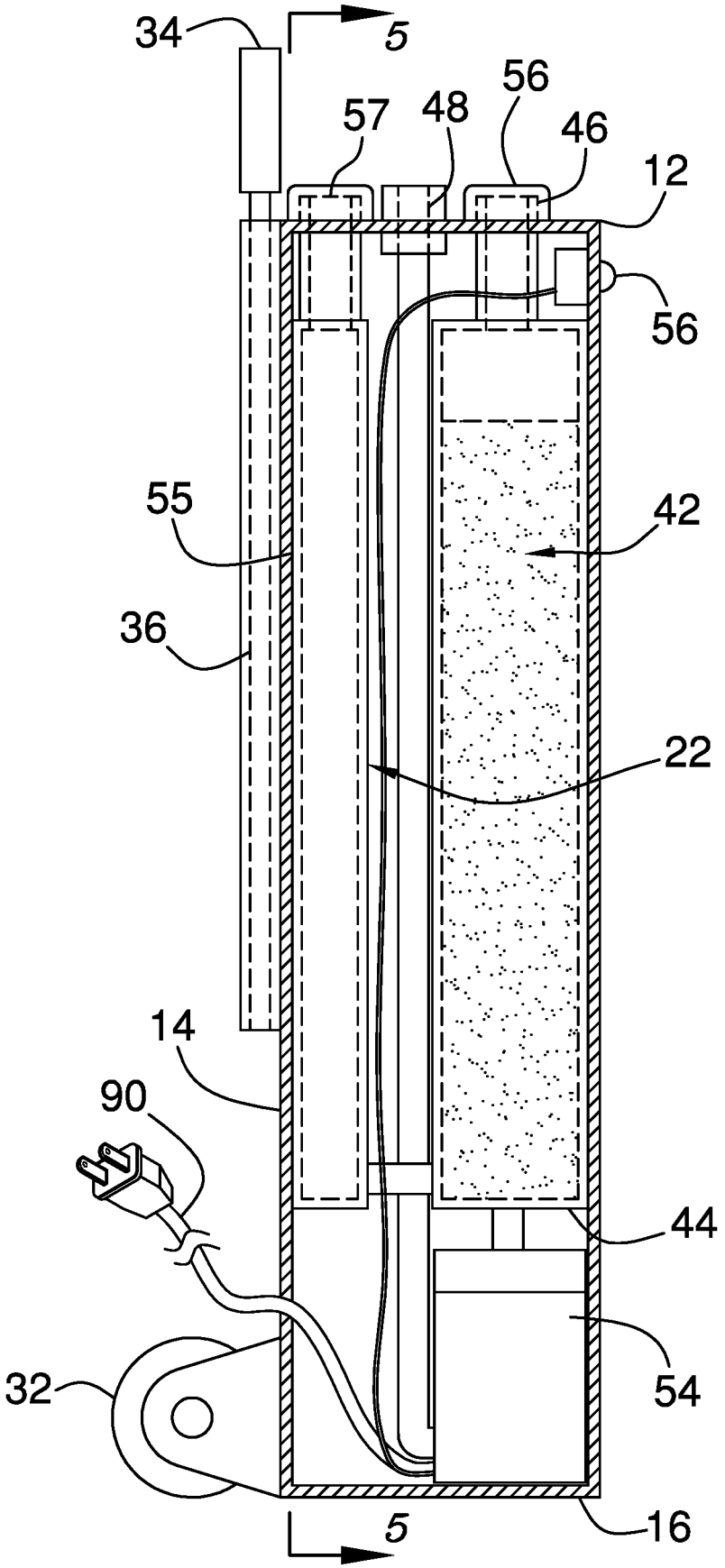
FIG. 4 is a cross sectional view taken along line 4-4 of FIG. 3 of an embodiment of the disclosure.
Figure 5:
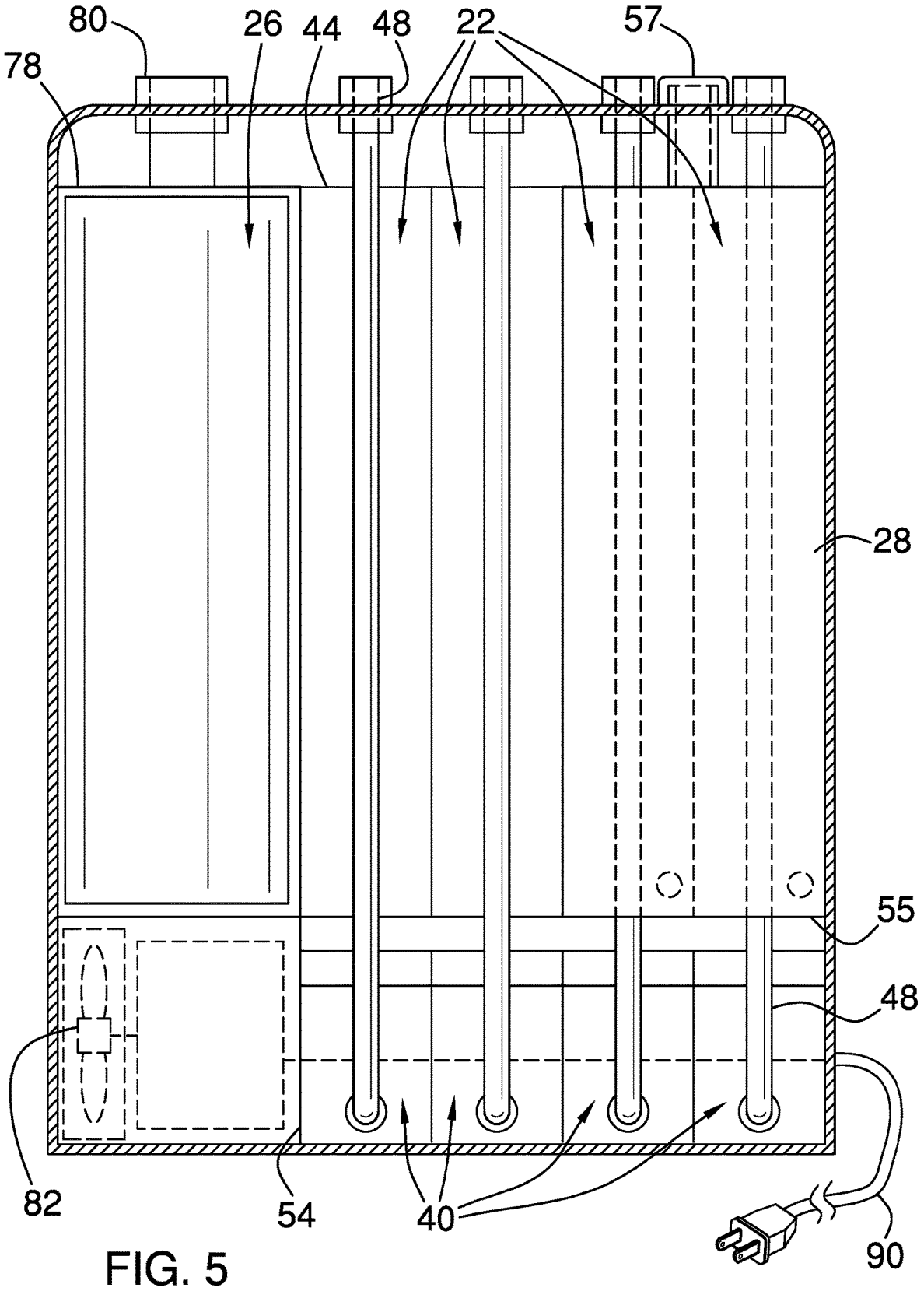
FIG. 5 is a cross sectional view taken along line 5-5 of FIG. 4 of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the bathroom cleaning assembly 10 generally comprises a housing 12 that has a back wall 14 and a perimeter wall 16. The perimeter wall 16 has a top side 18 and a bottom side 20 and the housing 12 has a plurality of chambers 22 therein. Each of the chambers 22 extends between the top side 18 and the bottom side 20 and the back wall 14 has an aperture 24 extending into an interior of the housing 12. The plurality of chambers 22 includes a vacuum chamber 26 and a plurality of reservoir chambers 28 and the aperture 24 is aligned with the vacuum 78 chamber 26. The perimeter wall 16 has a vent 30 extending into an interior of the housing 12 to pass air therethrough and the vent 30 is aligned with the vacuum 78 chamber 26.

A handle 32 is slidably coupled to the housing 12 for transporting the housing 12. The handle 32 is selectively positioned between a deployed position and a stored position. The handle 32 includes a central member 34 extending between a pair of outward members 36. Each of the outward members 36 is slidably positioned on the back side of the housing 12. The central member 34 is spaced from the top side 18 of the housing 12 when the handle 32 is positioned in the deployed position thereby facilitating the central member 34 to be gripped. The central member 34 is aligned with the top side 18 of the housing 12 when the handle 32 is positioned in the stored position.

A pair of wheels 38 is each rotatably coupled to the housing 12 and each of the wheels 38 may roll along a support surface such as a floor or the like. Each of the wheels 38 is positioned on the back wall 14 and each of the wheels 38 is aligned with the bottom side 20 of the housing 12. The handle 32 is positioned in the deployed position, the central member 34 is gripped and the housing 12 is rocked backwardly onto the wheels 38 to transport the housing 12.

A plurality of dispensing units 40 is provided and each of the dispensing units 40 is positioned in the housing 12. Each of the dispensing units 40 contains a fluid 42. The fluid 42 in each of the dispensing units 40 may comprise a cleaning solution, including, but not being limited to, clean water, a mixture of water and soap, and a liquid disinfectant such as chlorine bleach or the like. Additionally, each of the dispensing units 40 selectively dispenses the fluid 42 contained therein for cleaning and disinfecting a bathroom.

Each of the dispensing units 40 comprises a reservoir 44 that is positioned within an associated one of the reservoir chambers 28 in the housing 12 and the reservoir 44 contains the fluid 42. The reservoir 44 extends substantially between the top side 18 and the bottom side 20 of the perimeter wall 16 of the housing 12. The reservoir 44 includes a fill port 46 and the fill port 46 extends upwardly through the top side 18 of the perimeter wall 16 of the housing 12. In this way the fill port 46 facilitates the reservoir 44 to be filled with the fluid 42. The reservoir 44 includes an outlet 48 and the outlet 48 extends upwardly through the top side 18 of the perimeter wall 16 of the housing 12.

A cap 50 is removably coupled to the fill port 46 to close the fill port 46. A pump 54 is positioned within an associated one of the chambers 22 and the pump 54 is fluidly coupled to the reservoir 44. The pump 54 urges the fluid 42 in the reservoir 44 outwardly through the outlet 48 when the pump 54 is turned on. The pump 54 may be an electric fluid pump for mechanically urging the fluid 42 outwardly from the outlet 48, an electric air pump for pressurizing an interior of the reservoir 44 and any other type of pump. A switch 56 is coupled to the housing 12 and the switch 56 is electrically coupled to the pump 54 such that the switch 56 turns the pump 54 on and off.

A hot water tank 55 is provided in the hot water tank 55 is positioned within the housing. The hot water tank 55 is fluidly coupled the reservoir 44 corresponding to each of the dispensing units 40 and the hot water tank 55 is selectively filled with hot water. In this way the hot water may be selectively mixed with the fluid 42 in each of the dispensing units 40 to enhance cleaning the bathroom. The hot water tank 55 has a fill spout 57 extending through the top side 18 of the housing 12 for filling the hot water tank 55.

A plurality of brushes 58 is provided and a selected one of the brushes 58 is selectively and fluidly coupled to a selected one of the dispensing units 40. The selected brush 58 dispenses the fluid 42 from the selected dispensing unit for cleaning the bathroom. Each of the brushes 58 comprises a hose 60 that has a first end 62 and a second end 64. A fitting 66 is coupled to the first end 62 and the fitting 66 is selectively and fluidly coupled to the outlet 48 on the reservoir 44 of the selected dispensing unit. In this way the hose 60 receives the fluid 42 in the reservoir 44 when the pump 54 is turned on.

Each of the brushes 58 includes a tube 68 that is selectively gripped and the tube 68 has a first end 70 and a second end 72. The second end 64 of the hose 60 is fluidly coupled to the first end 70 of the tube 68 to receive the fluid 42 from the hose 60. A scrubber 74 is fluidly coupled to the second end 64 of the tube 68 to frictionally engage a surface in the bathroom to clean the surface. The scrubber 74 is comprised of a fluid permeable material to dispense the fluid 42 onto the surface thereby enhancing cleaning the surface. The tube 68 may have a first section that is slidably coupled to a second section such that the tube 68 has a telescopically adjustable length. The scrubber 74 may comprise a plurality of bristles, an abrasive sponge and any other scrubbing material.

A vacuum 78 is removably positioned in the vacuum chamber 26. The vacuum 78 is selectively removable through the aperture 24 for emptying the vacuum 78. The vacuum 78 has a suction port 80 extending upwardly through the top side 18 of the housing 12 to suck air therethrough. Additionally, the vacuum 78 has an exhaust port 82 that is aligned with the vent 30 to blow air outwardly through the vent 30. The vacuum 78 may be an electric canister vacuum or the like.

A vacuum hose 84 is selectively and fluidly coupled to the suction port 80 for vacuum 78ing the debris. A cover 86 is provided and the cover 86 is removably coupled to the back wall 14 of the housing 12. The cover 86 closes the aperture 24 to retain the vacuum 78 within the vacuum 78 chamber 26.

A power supply 88 is coupled to the housing 12 and the power supply 88 is electrically coupled to the pump 54 corresponding to each of the dispensing units 40 and the vacuum 78. The power supply 88 comprising a power cord 90 extending outwardly from the housing 12. The power cord 90 has a distal end 92 with respect to the housing 12 and a plug 94 is electrically coupled to the distal end 92. The plug 94 is selectively and electrically coupled to a power source 96 such as a female electrical outlet or the like.

In use, the reservoir 44 corresponding to each of the dispensing units 40 is filled with the selected fluid 42. The handle 32 is urged into the deployed position and the housing 12 is rolled into the bathroom. A selected one of the brushes 58 is fluidly coupled the outlet 48 on the reservoir 44 of a selected dispensing unit. The switch 56 corresponding to the selected dispensing unit is manipulated to turn on the pump 54 corresponding to the selected dispensing unit. Thus, the fluid 42 in the selected dispensing unit is urged outwardly through the selected brush 58 for cleaning the bathroom. The vacuum hose 84 is selectively coupled to the suction port 80 for vacuum 78ing the bathroom. Moreover, the vacuum 78 is selectively removed through the aperture 24 to empty the vacuum 78.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathroom cleaning assembly being configured to discreetly contain and selectively dispense a plurality of cleaning solutions for cleaning a bathroom, said assembly comprising:

a housing, said housing having a back wall and a perimeter wall, said perimeter wall having a top side and a bottom side, said housing having a plurality of chambers therein, each of said chambers extending between said top side and said bottom side, said back wall having an aperture extending into an interior of said housing, said plurality of chambers including a vacuum chamber and a plurality of reservoir chambers, said aperture being aligned with said vacuum chamber, said perimeter wall having a vent extending into an interior of said housing wherein said event is configured to pass air therethrough, said vent being aligned with said vacuum chamber;

a handle being slidably coupled to said housing wherein said handle is configured to be gripped;

a pair of wheels, each of said wheels being rotatably coupled to said housing wherein each of said wheels is configured to roll along a support surface;

a plurality of dispensing units, each of said dispensing units being positioned in said housing, each of said dispensing units being configured to contain a fluid;

a plurality of brushes, a selected one of said brushes being selectively and fluidly coupled to a selected one of said dispensing units wherein said selected brushes configured to dispense the fluid from said selected dispensing unit for cleaning the bathroom; and a vacuum unit being positioned in said housing wherein said vacuum unit is configured to vacuum debris from the bathroom, said vacuum unit comprising a vacuum being removably positioned in said vacuum chamber such that said vacuum is selectively removable through said aperture.

2. The assembly according to claim 1, further comprising said handle being selectively positioned between a deployed position and a stored position, said handle having a central member extending between a pair of outward members, each of said outward members being slidably positioned on said back side of said housing, said central member being spaced from said top side of said housing when said handle is positioned in said deployed position wherein said central member is configured to be gripped, said central member being aligned with said top side of said housing when said handle is positioned in said stored position.

3. The assembly according to claim 1, wherein each of said dispensing units comprises a reservoir being positioned within an associated one of said reservoir chambers in said housing, said reservoir being configured to contain the fluid, said reservoir extending substantially between said top side and said bottom side of said perimeter wall of said housing.

4. The assembly according to claim 3, wherein said reservoir includes:

a fill port, said fill port extending upwardly through said top side of said perimeter wall of said housing wherein said fill port is configured to facilitate the reservoir to be filled with the fluid; and an outlet, said outlet extending upwardly through said top side of said perimeter wall of said housing.

5. The assembly according to claim 4, further comprising a cap being removably coupled to said fill port to close said fill port.

6. The assembly according to claim 4, further comprising a pump being positioned within an associated one of said chambers, said pump being fluidly coupled to said reservoir wherein said pump is configured to urge the fluid in the said reservoir outwardly through said outlet when said pump is turned on.

7. The assembly according to claim 6, further comprising a switch being coupled to said housing wherein said switch is configured to be manipulated, said switch being electrically coupled to said pump such that said switch turns said pump on and off.

8. A bathroom cleaning assembly being configured to discreetly contain and selectively dispense a plurality of cleaning solutions for cleaning a bathroom, said assembly comprising:

a housing, said housing having a back wall and a perimeter wall, said perimeter wall having a top side and a bottom side, said housing having a plurality of chambers therein, each of said chambers extending between said top side and said bottom side, said back wall having an aperture extending into an interior of said housing, said plurality of chambers including a vacuum chamber and a plurality of reservoir chambers, said aperture being aligned with said vacuum chamber, said perimeter wall having a vent extending into an interior of said housing wherein said event is configured to pass air therethrough, said vent being aligned with said vacuum chamber;

a handle being slidably coupled to said housing wherein said handle is configured to be gripped;

a pair of wheels, each of said wheels being rotatably coupled to said housing wherein each of said wheels is configured to roll along a support surface;

a plurality of dispensing units, each of said dispensing units being positioned in said housing, each of said dispensing units being configured to contain a fluid, each of said dispensing units comprising a reservoir being positioned within an associated one of said reservoir chambers in said housing, said reservoir being configured to contain the fluid, said reservoir extending substantially between said top side and said bottom side of said perimeter wall of said housing, said reservoir comprising a fill port, said fill port extending upwardly through said top side of said perimeter wall of said housing wherein said fill port is configured to facilitate the reservoir to be filled with the fluid, an outlet, said outlet extending upwardly through said top side of said perimeter wall of said housing, and a pump being positioned within an associated one of said chambers, said pump being fluidly coupled to said reservoir wherein said pump is configured to urge the fluid in the said reservoir outwardly through said outlet when said pump is turned on;

a plurality of brushes, a selected one of said brushes being selectively and fluidly coupled to a selected one of said dispensing units wherein said selected brushes configured to dispense the fluid from said selected dispensing unit for cleaning the bathroom;

a vacuum unit being positioned in said housing wherein said vacuum unit is configured to vacuum debris from the bathroom; and each of said brushes comprising a hose having a first end and a second end, and a fitting being coupled to said first end, said fitting being selectively and fluidly coupled to said outlet on said reservoir of said selected dispensing unit wherein said hose is configured to receive the fluid in the reservoir.

9. The assembly according to claim 8, further comprising a tube being configured to be gripped, said tube having a first end and a second end, said second end of said hose being fluidly coupled to said first end of said tube wherein said tube is configured to receive the fluid from said hose.

10. The assembly according to claim 9, further comprising a scrubber being fluidly coupled to said second end of said tube wherein said scrubber is configured to frictionally engage a surface in the bathroom to clean the surface, said scrubber being comprised of a fluid permeable material wherein said scrubber is configured to dispense the fluid onto the surface thereby enhancing cleaning the surface.

11. The assembly according to claim 1, wherein said vacuum has a suction port extending upwardly through said top side of said housing wherein said suction port is configured to suck air therethrough.

12. The assembly according to claim 11, wherein said vacuum has an exhaust port being aligned with said vent wherein said exhaust port is configured to blow air outwardly through said vent, said suction port having a vacuum hose being selectively and fluidly coupled thereto for vacuuming the debris.

13. The assembly according to claim 12, further comprising a power supply being coupled to said housing, said power supply being electrically coupled to said pump corresponding to each of said dispensing units and said vacuum, said power supply comprising a power cord extending outwardly from said housing, said power cord having a with respect to said housing, said distal end having a plug being electrically coupled thereto, said plug being configured to be electrically coupled to a power source.

14. A bathroom cleaning assembly being configured to discreetly contain and selectively dispense a plurality of cleaning solutions for cleaning a bathroom, said assembly comprising:

a housing having a back wall and a perimeter wall, said perimeter wall having a top side and a bottom side, said housing having a plurality of chambers therein, each of said chambers extending between said top side and said bottom side, said back wall having an aperture extending into an interior of said housing, said plurality of chambers including a vacuum chamber and a plurality of reservoir chambers, said aperture being aligned with said vacuum chamber, said perimeter wall having a vent extending into an interior of said housing wherein said event is configured to pass air therethrough, said vent being aligned with said vacuum chamber;

a handle being slidably coupled to said housing wherein said handle is configured to be gripped, said handle being selectively positioned between a deployed position and a stored position, said handle having a central member extending between a pair of outward members, each of said outward members being slidably positioned on said back side of said housing, said central member being spaced from said top side of said housing when said handle is positioned in said deployed position wherein said central member is configured to be gripped, said central member being aligned with said top side of said housing when said handle is positioned in said stored position;

a pair of wheels, each of said wheels being rotatably coupled to said housing wherein each of said wheels is configured to roll along a support surface, each of said wheels being positioned on said back wall, each of said wheels being aligned with said bottom side of said housing;

a plurality of dispensing units, each of said dispensing units being positioned in said housing, each of said dispensing units being configured to contain a fluid, each of said dispensing units comprising:

a reservoir being positioned within an associated one of said reservoir chambers in said housing, said reservoir being configured to contain the fluid, said reservoir extending substantially between said top side and said bottom side of said perimeter wall of said housing, said reservoir including a fill port, said fill port extending upwardly through said top side of said perimeter wall of said housing wherein said fill port is configured to facilitate the reservoir to be filled with the fluid, said reservoir including an outlet, said outlet extending upwardly through said top side of said perimeter wall of said housing;

a cap being removably coupled to said fill port to close said fill port;

a pump being positioned within an associated one of said chambers, said pump being fluidly coupled to said reservoir wherein said pump is configured to urge the fluid in the said reservoir outwardly through said outlet when said pump is turned on;

a switch being coupled to said housing wherein said switch is configured to be manipulated, said switch being electrically coupled to said pump such that said switch turns said pump on and off;

a plurality of brushes, a selected one of said brushes being selectively and fluidly coupled to a selected one of said dispensing units wherein said selected brushes configured to dispense the fluid from said selected dispensing unit for cleaning the bathroom, each of said brushes comprising:

a hose having a first end and a second end, a fitting being coupled to said first end, said fitting being selectively and fluidly coupled to said outlet on said reservoir of said selected dispensing unit wherein said hose is configured to receive the fluid in the reservoir, a tube being configured to be gripped, said tube having a first end and a second end, said second end of said hose being fluidly coupled to said first end of said tube wherein said tube is configured to receive the fluid from said hose, and a scrubber being fluidly coupled to said second end of said tube wherein said scrubber is configured to frictionally engage a surface in the bathroom to clean the surface, said scrubber being comprised of a fluid permeable material wherein said scrubber is configured to dispense the fluid onto the surface thereby enhancing cleaning the surface;

a vacuum unit being positioned in said housing wherein said vacuum unit is configured to vacuum debris from the bathroom, said vacuum unit comprising a vacuum being removably positioned in said vacuum chamber such that said vacuum is selectively removable through said aperture, said vacuum having a suction port extending upwardly through said top side of said housing wherein said suction port is configured to suck air therethrough, said vacuum having an exhaust port being aligned with said vent wherein said exhaust port is configured to blow air outwardly through said vent, said suction port having a vacuum hose being selectively and fluidly coupled thereto for vacuuming the debris; and a power supply being coupled to said housing, said power supply being electrically coupled to said pump corresponding to each of said dispensing units and said vacuum, said power supply comprising a power cord extending outwardly from said housing, said power cord having a with respect to said housing, said distal end having a plug being electrically coupled thereto, said plug being configured to be electrically coupled to a power source.

* * * * *